US008833512B2

(12) United States Patent
Smith et al.

(10) Patent No.: US 8,833,512 B2
(45) Date of Patent: Sep. 16, 2014

(54) FIREARM SOUND SUPPRESSOR BAFFLE

(71) Applicant: Smith Enterprise, Inc., Tempe, AZ (US)

(72) Inventors: Ronald Smith, Tempe, AZ (US); Peter Lipsio, Bullhead City, AZ (US)

(73) Assignee: Smith Enterprise, Inc., Tempe, AZ (US)

( * ) Notice: Subject to any disclaimer, the term of this patent is extended or adjusted under 35 U.S.C. 154(b) by 0 days.

(21) Appl. No.: 13/740,991

(22) Filed: Jan. 14, 2013

(65) Prior Publication Data

US 2014/0076658 A1 Mar. 20, 2014

Related U.S. Application Data

(60) Provisional application No. 61/586,674, filed on Jan. 13, 2013.

(51) Int. Cl.
*F41A 21/30* (2006.01)

(52) U.S. Cl.
CPC ..... *F41A 21/30* (2013.01)
USPC ..... 181/223; 89/14.4

(58) Field of Classification Search
CPC ..... F41A 21/30
USPC ..... 181/223; 89/14.4
See application file for complete search history.

(56) References Cited

U.S. PATENT DOCUMENTS

| | | | | |
|---|---|---|---|---|
| 2,375,617 | A * | 5/1945 | Bourne | 181/223 |
| 4,584,924 | A * | 4/1986 | Taguchi | 89/14.4 |
| 5,164,535 | A * | 11/1992 | Leasure | 89/14.4 |
| 6,302,009 | B1 * | 10/2001 | O'Quinn et al. | 89/14.4 |
| 7,587,969 | B2 * | 9/2009 | Silvers | 89/14.4 |
| 7,931,118 | B1 * | 4/2011 | Cronhelm | 181/223 |
| 7,987,944 | B1 * | 8/2011 | Brittingham et al. | 181/223 |

* cited by examiner

*Primary Examiner* — Jeremy Luks
(74) *Attorney, Agent, or Firm* — The Noblitt Group, PLLC

(57) ABSTRACT

A baffle for use in a firearm sound suppressor is provided. The baffle defines a central bore extending from a first face of the baffle to a second face and sized to allow a projectile fired from a firearm to freely pass along a longitudinal axis of the baffle. A plurality of grooves are defined in the first face and a plurality of channels are defined in the second face. Each groove begins adjacent to or near the peripheral wall and extends from the first face towards the second face and the central bore along a groove axis and each channel begins adjacent to or near the peripheral wall and extends s from the second face towards the first face and the central bore along a channel axis. Each groove of the first face can be substantially aligned with a channel of the second face. The baffle can be one of a plurality of baffles in a baffle stack.

19 Claims, 4 Drawing Sheets

FIREARM SOUND SUPPRESSOR BAFFLE

CROSS REFERENCE TO RELATED APPLICATIONS

This application is a non-provisional of U.S. Provisional Patent Application No. 61/586,674, filed Jan. 13, 2012, which application is incorporated herein by reference in its entirety.

FIELD OF THE INVENTION

The field of this invention relates generally to sound baffles and more particularly to a baffle for use in firearm sound suppressors.

BACKGROUND OF THE INVENTION

Firearm sound suppressors reduce the sound level caused by the discharge of a firearm. This sound can be created when pressurized burning gases from the firearm discharge contact surrounding cooler air and by a sonic boom created from a projectile traveling faster than the speed of sound. Conventional firearm sound suppressors include a tubular housing with a series of baffles inside the housing to redirect and slow the release of the pressurized gases. The delay in the release of the gas allows for the gas to partially cool thereby reducing the volume of gas released. The redirection and slowing of the velocity of escaping gas can also lower the speed to a subsonic level. These baffles have various shapes and profiles to attempt to effectively disperse the burning gases and lower the sound level of the muzzle blast. However, it would be desirable to further suppress the sound level of a firearm discharge than that is achievable by a suppressor having conventional baffles.

Some conventional firearm sound suppressors are limited to use within a narrow range of projectile calibers. Thus, a user of a conventional sound suppressor could be required to purchase and/or use a variety of firearm sound suppressors for use on different firearms.

Additionally, upon discharge of the firearm, materials such as carbon and gun powder residue can be deposited in the firearm sound suppressor. Most conventional firearm sound suppressors cannot be disassembled in order to remove these deposits and the suppressor must be replaced. Conventional firearm sound suppressors that can be disassembled can require specialized tools for disassembly for cleaning of the baffles and/or other internal components. After cleaning, a user of a conventional firearm sound suppressor must pay careful attention to the order and/or orientation of baffles as they are inserted into the housing. Mistakes in the order and/or orientation of conventional baffles can cause the suppressor to not function as designed.

In view of the preceding, there is a need for a baffle for use in firearm sound suppressors that more effectively reduces the sound level of a firearm discharge, that can be used with a variety of caliber projectiles, and can be easily insertable and/or removable from a suppressor housing for cleaning

SUMMARY OF THE INVENTION

This application relates to a baffle for use in a firearm sound suppressor. In one aspect, the baffle can define a central bore extending from a first face of the baffle to a second face of the baffle. In another aspect, the central bore can be sized to allow a projectile fired from a firearm to freely pass along a longitudinal axis $L_A$ of the baffle. In a further aspect, a peripheral wall can be positioned between the first and second faces.

A plurality of grooves can be defined in the first face. In one aspect, each groove of the plurality of grooves can begin adjacent to the peripheral wall, or near a location spaced from the peripheral wall of the baffle. In this aspect, each groove can extend inwardly from the first face towards the second face and the central bore along a groove axis. In another aspect, the plurality of grooves can comprise three grooves spaced from each other.

A plurality of channels can be defined in the second face. In one aspect, each channel of the plurality of channels can begin adjacent to the peripheral wall, or near a location spaced from the peripheral wall of the baffle. In this aspect, each channel can extend inwardly from the second face towards the first face and the central bore along a channel axis. In another aspect, the plurality of channels can comprise three channels spaced from each other.

In one aspect, each groove of the plurality of grooves of the first face can be substantially aligned with a channel of the plurality of channels of the second face. In this aspect, the groove axis of each groove can be substantially parallel to the channel axis of a channel. For example, a first channel of the second face can be positioned so that the channel axis of the first channel is substantially parallel to the groove axis of the first groove of the first face.

In use, in one aspect, the baffle can be inserted into a housing of a firearm sound suppressor to slow the flow of pressurized gas released from the muzzle of a firearm. In another aspect, a plurality of baffles can be inserted into the housing of a sound suppressor to form a baffle stack. In still another aspect, each baffle can be spaced from adjacent baffles by an annular spacer. This baffle stack can further slow the flow of pressurized gas released from the muzzle of a firearm, absorbing heat and kinetic energy of pressurized burning gases.

In one aspect, because the first face of the baffle can be substantially the same as the second face, a baffle can be inserted into the housing with either face being inserted first. Thus, the baffle stack can quickly be formed and with minimal training and error.

In another aspect, the number of baffles and/or spacers can be varied as desired to accommodate firearms of different calibers.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE FIGURES

These and other features of the preferred embodiments of the invention will become more apparent in the detailed description in which reference is made to the appended drawings wherein.

DETAILED DESCRIPTION OF THE INVENTION

Figure 1:
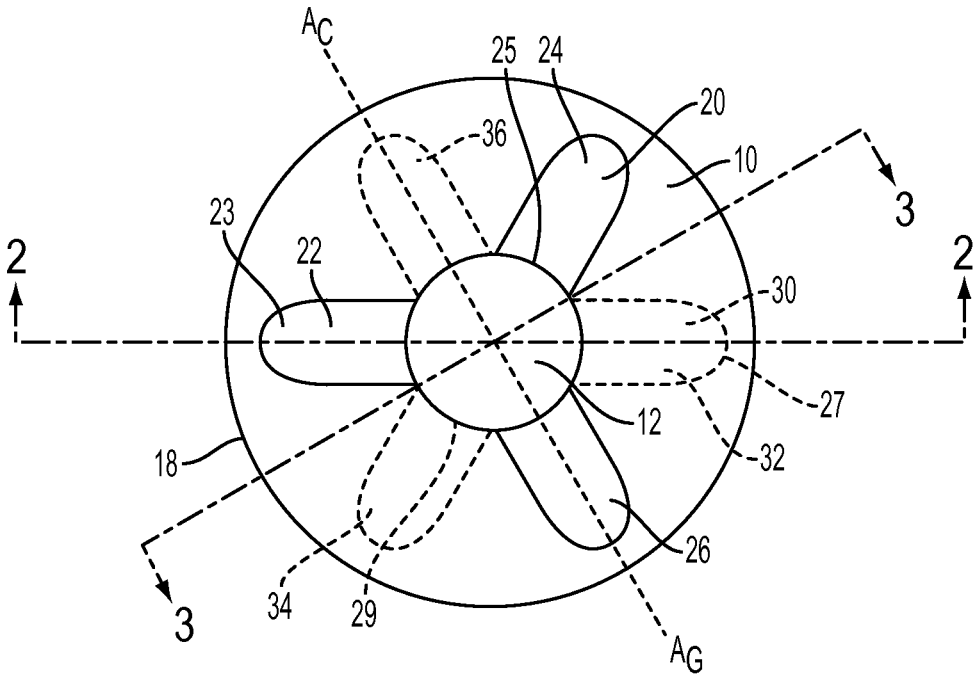
FIG. 1 is an elevational view of one embodiment of a baffle for a firearm sound suppressor, showing a first face of the baffle.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a baffle" can include two or more such baffles unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

A baffle 10 for use in a firearm sound suppressor is provided, according to various aspects. Referring to FIGS. 1-5, in one aspect, the baffle can define a central bore 12 extending from a first face 14 of the baffle to an opposed second face 16. In one aspect, the central bore can be configured to permit a projectile discharged from a firearm to freely pass along a longitudinal axis $L_A$ of the baffle through the baffle in a firing direction. In another aspect, the central bore can be substantially circular in shape. It is contemplated, however, that the central bore 12 can be other shapes such as, substantially triangular, substantially square, substantially pentagonal, substantially hexagonal, substantially octagonal, or any other shape. In a further aspect, the central bore can have an inner diameter of less than about 0.1 inches, about 0.1 inches, about 0.2 inches, about 0.3 inches, about 0.4 inches, about 0.5 inches, about 0.6 inches, about 0.7 inches, about 0.8 inches, about 0.9 inches, about 1.0 inch, or greater than about 1.0 inch.

In one aspect, the baffle 10 can be substantially cylindrical in shape and sized to conform to an inner diameter of a suppressor housing. For example, the baffle can have an outer diameter of less than about 0.5 inches, about 0.5 inches, about 0.75 inches, about 1 inch, about 1.05 inches, about 1.10 inches, about 1.15 inches, about 1.20 inches, about 1.25 inches, about 1.30 inches, about 1.35 inches about 1.40 inches, about 1.45 inches, about 1.5 inches, about 1.75 inches, about 2 inches, about 2.25 inches, about 2.5 inches, about 2.75 inches, about 3 inches, or greater than about 3 inches. It is contemplated, however, that the baffle can be formed from other shapes and/or sizes as necessary to conform to a housing of a suppressor.

In one aspect, the baffle 10 can be formed from metallic materials such as aluminum, aluminum alloys, stainless steel, titanium and the like. For example and without limitation, the baffle can be formed from an aluminum alloy such as 6061-T6 or Type 304 stainless steel.

The baffle 10 can comprise the first face 14 positioned in a plane substantially normal to the longitudinal axis of the baffle, and the second face 16 spaced from and positioned in a plane substantially parallel to the first face, according to one aspect. In another aspect, a peripheral wall 18 extends between the first and second faces. As can be appreciated, the height of the peripheral wall can define the thickness of the baffle 10 relative to the longitudinal axis $L_A$. For example, the baffle can have a thickness of less than about 0.1 inches, about 0.1 inches, about 0.2 inches, about 0.3 inches, about 0.4 inches, about 0.5 inches, about 0.6 inches, about 0.7 inches, about 0.8 inches, about 0.9 inches, about 1.0 inch, or greater than about 1.0 inch.

In one aspect, a plurality of grooves 20 can be defined in the first face 14 of the baffle 10. For example and without limitation, the plurality of grooves can comprise a first groove 22, a second groove 24 and a third groove 26, as illustrated in FIG. 1. In another aspect, each groove of the plurality of grooves of the first face 14 can be substantially "U" shaped in cross-section, though it is contemplated that in cross-section each groove can be substantially circular, substantially oval and the like. In a further aspect, it is contemplated that a bottom portion 21 of each of the plurality of grooves can comprise a substantially planar surface. In an additional aspect, each groove of the plurality of grooves can have a groove width of less than about 0.10 inches, about 0.10 inches, about 0.11 inches, about 0.12 inches, about 0.13 inches, about 0.14 inches, about 0.15 inches, about 0.16 inches, about 0.17 inches, about 0.18 inches, about 0.19 inches, about 0.20 inches, about 0.22 inches, about 0.24 inches, about 0.26 inches, about 0.28 inches, about 0.30 inches, about 0.32 inches, about 0.34 inches, about 0.36 inches, about 0.38 inches, about 0.40 inches, about 0.45 inches, about 0.50 inches, or greater than about 0.50 inches.

In one aspect, each groove 20 of the plurality of grooves of the first face 14 can begin at a proximal end 23 adjacent to the peripheral wall 18 of the baffle 10 or at a location spaced from the peripheral wall of the baffle a predetermined groove distance. In an example, each groove 20 can begin at a location spaced form the peripheral wall 18 of the baffle 10 by less than about 0.01 inches, about 0.01 inches, about 0.02 inches, about 0.03 inches, about 0.033 inches, about 0.04 inches, about 0.05 inches, about 0.06 inches, about 0.07 inches, about 0.08 inches, about 0.09 inches, about 0.10 inches, about 0.12 inches, about 0.14 inches, about 0.16 inches, about 0.18 inches, about 0.20 inches, about 0.25 inches, about 0.30 inches, about 0.35 inches, about 0.40 inches, about 0.45 inches, about 0.50 inches, or greater than about 0.50 inches.

In another aspect, each groove 20 of the plurality of grooves of the first face 14 can extend substantially parallel to a plane containing the longitudinal axis $L_A$ of the baffle 10 from the first face 14 towards the second face 16 and the central bore 12 along a groove axis $A_G$, to a distal end 25 of the groove 20. In another aspect, each groove 20 of the plurality of grooves can extend in a plane bisecting the longitudinal axis $L_A$ of the baffle 10 downwardly from the first face 14 towards the second face 16 and the central bore 12 along the groove axis $A_G$ to a distal end 25 of the groove 20. In yet another aspect, each groove 20 of the plurality of grooves may comprise a groove axis $A_G$ that may extend in a downwardly projecting plane intersecting the longitudinal axis $L_A$ of the baffle 10 along the groove axis $A_G$ downwardly from the first face 14 towards the second face 16 and the central bore 12 adjacent to a distal end 25 of a bottom portion 21 of the groove 20. In a further aspect, the bottom portion 21 of each groove 20 can taper inwardly therein the baffle 10 substantially parallel to a plane containing the longitudinal axis $L_A$ from the first face 14 towards the second face 16 and the central bore 12 along the groove axis $A_G$. That is, the bottom portion 21 of each groove 20 can taper inwardly substantially parallel to the groove axis $A_G$ and at an acute angle relative to the longitudinal axis $L_A$ of the baffle 10. Thus, a centerline of each groove 20 can extend from an outer portion of the first face 14 inwardly toward the second face 16 and the central bore 12 along the groove axis $A_G$. In another aspect, the groove axis $A_G$ of a first groove can be coplanar to the groove axes of any other grooves.

Figure 4:
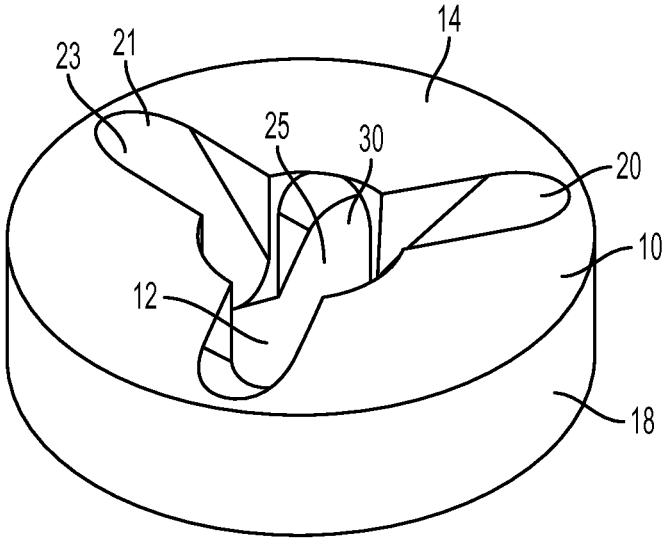
FIG. 4 is a perspective view of the baffle of FIG. 1, showing a first face of the baffle.

As illustrated in FIG. 4, in one aspect, the distal end 25 of each groove 20 can be in fluid communication with the central bore 12 and can have a groove height extending from the first face 14 to the second face 16. In another aspect, the distal end of each groove can define at least a portion of the central bore.

Figure 2:
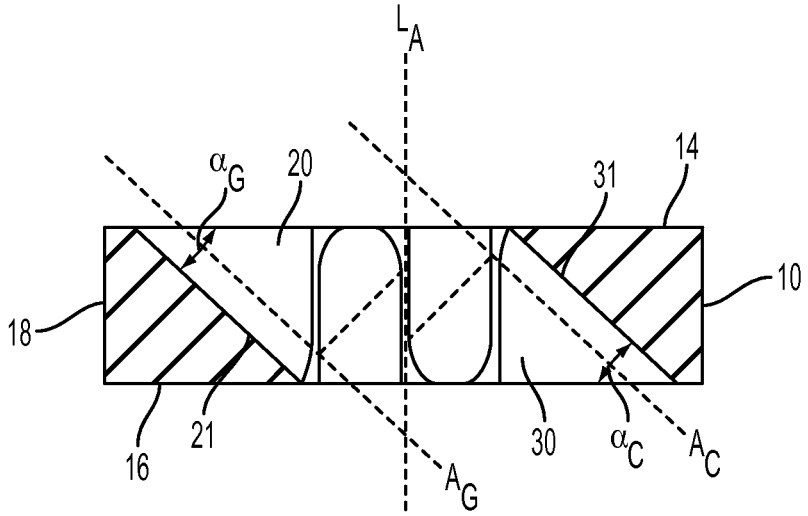
FIG. 2 is a cross-sectional view of the baffle of FIG. 1 taken along line 2-2.
Figure 3:
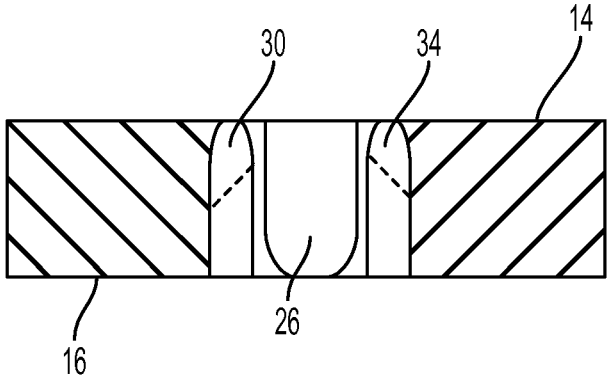
FIG. 3 is a cross-sectional view of the baffle of FIG. 1 taken along line 3-3.

With reference to FIG. 2, in one aspect, each groove 20 of the plurality of grooves of the first face 14 can extend from the first face towards the second face 16 and the central bore 12 at a groove angle $\alpha_G$ relative to the first face. As can be appreciated, the groove angle $\alpha_G$ can also be expressed as the angle formed by a groove extending from the first face towards the second face and the central bore relative to the longitudinal axis of the baffle. For example, the groove angle can be less than about 5°, about 5°, about 10°, about 15°, about 20°, about 25°, about 26°, about 30°, about 35°, about 40°, about 45°, about 50°, about 55°, about 60°, about 65°, about 70°, about 75°, about 80°, about 85°, or about 90°.

In one aspect, each groove 20 of the plurality of grooves of the first face 14 can be spaced from each other. In another aspect, each groove of the plurality of grooves of the first face 14 can be spaced substantially equally spaced from each other. For example, if two grooves are defined in the first face 14 of the baffle 10, the groove axis $A_G$ of the two grooves can be spaced about 180° from each other. In another example, if three grooves are defined in the first face of the baffle, as illustrated in FIG. 1, the groove axis of each of the three grooves can be spaced about 120° from each other.

While each groove 20 of the plurality of grooves of the first face 14 can be shaped substantially the same as the other respective grooves, it is contemplated that a groove can be shaped differently than other grooves. For example, the first groove 22 can begin adjacent the peripheral wall 18, and the second groove 24 can begin at a location spaced from the peripheral wall. In another example, the first groove 22 can have a groove width greater than the groove width of the third groove 26.

In one aspect, a plurality of channels 30 can be defined in the second face 16 of the baffle 10. For example and without limitation, the plurality of channels can comprise a first channel 32, a second channel 34 and a third channel 36, as illustrated in broken lines in FIG. 1. In another aspect, each channel of the plurality of channels of the second face can be substantially "U" shaped in cross-section, though it is contemplated that in cross-section each channel can be substantially circular, substantially oval and the like. In a further aspect, it is contemplated that a bottom portion 31 of each of the plurality of channels can comprise a substantially planar surface. In an additional aspect, each channel of the plurality of channels can have a channel width of less than about 0.10 inches, about 0.10 inches, about 0.11 inches, about 0.12 inches, about 0.13 inches, about 0.14 inches, about 0.15 inches, about 0.16 inches, about 0.17 inches, about 0.18 inches, about 0.19 inches, about 0.20 inches, about 0.22 inches, about 0.24 inches, about 0.26 inches, about 0.28 inches, about 0.30 inches, about 0.32 inches, about 0.34 inches, about 0.36 inches, about 0.38 inches, about 0.40 inches, about 0.45 inches, about 0.50 inches, or greater than about 0.50 inches.

In one aspect, each channel 30 of the plurality of channels of the second face 16 can begin at a proximal end 27 adjacent to the peripheral wall 18 of the baffle 10 or at a location spaced from the peripheral wall of the baffle a predetermined channel distance. In an example, each channel can begin at a location spaced form the peripheral wall 18 of the baffle 10 by less than about 0.01 inches, about 0.01 inches, about 0.02 inches, about 0.03 inches, about 0.033 inches, about 0.04 inches, about 0.05 inches, about 0.06 inches, about 0.07 inches, about 0.08 inches, about 0.09 inches, about 0.10 inches, about 0.12 inches, about 0.14 inches, about 0.16 inches, about 0.18 inches, about 0.20 inches, about 0.25 inches, about 0.30 inches, about 0.35 inches, about 0.40 inches, about 0.45 inches, about 0.50 inches, or greater than about 0.50 inches.

In another aspect, each channel 30 of the plurality of channels of the second face 16 can extend substantially parallel to a plane containing the longitudinal axis $L_A$ of the baffle 10 from the second face 16 towards the first face 14 and the central bore 12 along a channel axis $A_C$ to a distal end 29 of the channel 30. In another aspect, each channel 30 of the plurality of channels can extend in a plane bisecting the longitudinal axis $L_A$ of the baffle 10 upwardly from the second face 16 towards the first face 14 and the central bore 12 along the channel axis $A_C$ to a distal end of the channel 30. In yet another aspect, each channel 30 of the plurality of channel may comprise a channel axis $A_C$ that may extend in a upwardly projecting plane intersecting the longitudinal axis of the baffle along the channel axis upwardly from the second face 16 towards the first face 14 and the central bore 12 adjacent to a distal end 29 of a bottom portion 31 of the channel 30. In a further aspect, the bottom portion 31 of each channel 30 can taper inwardly therein the baffle substantially parallel to a plane containing the longitudinal axis $L_A$ from the second face 16 towards the first face 14 and the central bore 12 along the channel axis $A_C$. That is, the bottom portion 31 of each channel 30 can taper inwardly substantially parallel to the channel axis $A_C$ and at an acute angle relative to the longitudinal axis $L_A$ of the baffle. Thus, a centerline of each channel 30 can extend from an outer portion of the second face 16 inwardly toward the first face 14 and the central bore 12 along the channel axis $A_C$.In another aspect, the channel axis $A_C$ of a first channel can be substantially coplanar to the channel axes of any other channels.

Figure 5:
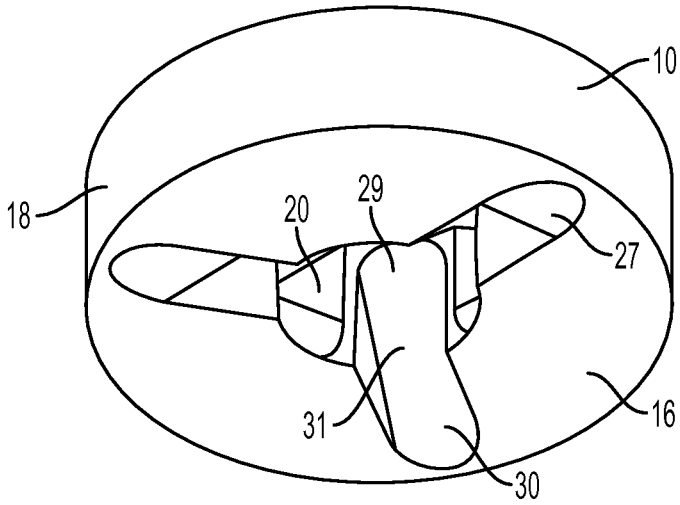
FIG. 5 is a perspective view of the baffle of FIG. 1, showing a second face of the baffle.

As illustrated in FIG. 5, in one aspect, the distal end 29 of each channel 30 can be in communication with the central bore 12 and can have a channel height extending from the second face 16 to the first face 14. In another aspect, the distal end of each channel can define at least a portion of the central bore.

With reference to FIG. 2, in one aspect, each channel 30 of the plurality of channels of the second face 16 can extend from the second face towards the first face 14 and the central bore 12 at a channel angle $\alpha_C$ relative to the second face. As can be appreciated, the channel angle $\alpha_C$ can also be expressed as the angle formed by a channel extending from the second face towards the first face and the central bore relative to the longitudinal axis $L_A$ of the baffle. For example, the channel angle can be less than about 5°, about 5°, about 10°, about 15°, about 20°, about 25°, about 26°, about 30°, about 35°, about 40°, about 45°, about 50°, about 55°, about 60°, about 65°, about 70°, about 75°, about 80°, about 85°, or about 90°. In one aspect, then, the channel angle $\alpha_C$ can be substantially the same as the groove angle $\alpha_G$.

In one aspect, the plurality of channels 30 of the second face 16 can be spaced from each other. In another aspect, each channel of the plurality of channels of the second face can be spaced equally spaced from each other. For example, if two channels are defined in the second face of the baffle 10, the channel axis $A_C$ of the two channels can be spaced about 180° from each other. In another example, if three channels are defined in the second face of the baffle, the channel axis of the three channels can be spaced about 120° from each other.

While each channel 30 of the plurality of channels can be shaped substantially the same as the other respective channels, it is contemplated that a channel can be shaped differently than other channels. For example, the first channel 32 can have a channel angle $\alpha_C$ of 30°, and the second channel 34 can have a channel angle of 45°. In another example, the first channel 32 can have a channel width greater than the channel width of the third channel 36.

In one aspect, each groove 20 of the plurality of grooves of the first face 14 can be substantially aligned with a channel 30 of the plurality of channels of the second face 16. In this aspect, the groove axis $A_G$ of each groove can be substantially parallel to the channel axis $A_C$ of a channel. In another aspect, the respective bottom portions 21, 31 of a respective pair of substantially aligned groove and channel can be positioned substantially parallel to each other and substantially parallel to the respective groove axis $A_G$ and channel axis $A_C$, illustrated in FIG. 2. For example, the first channel 32 of the second face can be positioned so that the channel axis of the first channel is substantially parallel to the groove axis of the first groove 22 of the first face, the second channel 34 of the second face can be positioned so that the channel axis of the second channel is substantially parallel to the groove axis of the second groove 24 of the first face 14, and the third channel 36 of the second face 16 can be positioned so that the channel axis of the third channel is substantially parallel to the groove axis of the third groove 26 of the first face. In a further aspect, each groove 20 of the plurality of grooves of the first face can substantially oppose a channel 30 of the plurality of channels of the second face. That is, and with reference to FIG. 1, each groove can be substantially aligned with a channel such that each groove is positioned across the central bore 12 from a channel.

As can be appreciated, in one aspect, the second face 16 can be substantially identical to the first face 14. In another aspect, each channel 30 of the second face 16 can be substantially identical to the respective grooves 20 of the first face 14. In still another aspect, each channel 30 of the second face can be positioned, relative to the other channels, substantially the same as the positioning of each groove 20 of the first face relative to the other grooves. One skilled in the art will appreciate that, when the groove axis $A_G$ of each groove is substantially parallel to the channel axis $A_C$ of each channel, in use, the baffle will operate the same regardless of whether the first face 14 or the second face 16 contacts the gas discharged from a firearm first.

In use, the baffle 10 can disperse heat and pressure in burning gases accompanying a fired projectile. If the first face 14 is positioned closest to the pressurized, burning gases, when pressurized gases approach the baffle, the gas flow can be divided such that a portion of the gases enter the central bore 12 of the baffle and a portion of the gases are redirected by the grooves 20 of the first face. The portion of the gases redirected by the grooves force the gas to move at least partially transversely relative to the projectile path (and the longitudinal axis of the baffle) and into the channels 30 of the second face. This redirection of gases produces more turbulent gas flow and contributes to reducing the heat and kinetic energy of the overall flow. When a plurality of baffles are present within a suppressor, as described more fully below, the transverse flow of gas can displace at least a portion of the generally linear flow of pressurized gases following the projectile through the central bore 12 of the baffle. Consequently the baffle 10 absorbs heat and kinetic energy of pressurized burning gases flowing from a muzzle of a firearm by breaking up the flow of gases, creating turbulence and cross-flows in the gases and separating the gases into different grooves 20 and/or channels 30 defined in the baffle 10.

Figure 6:
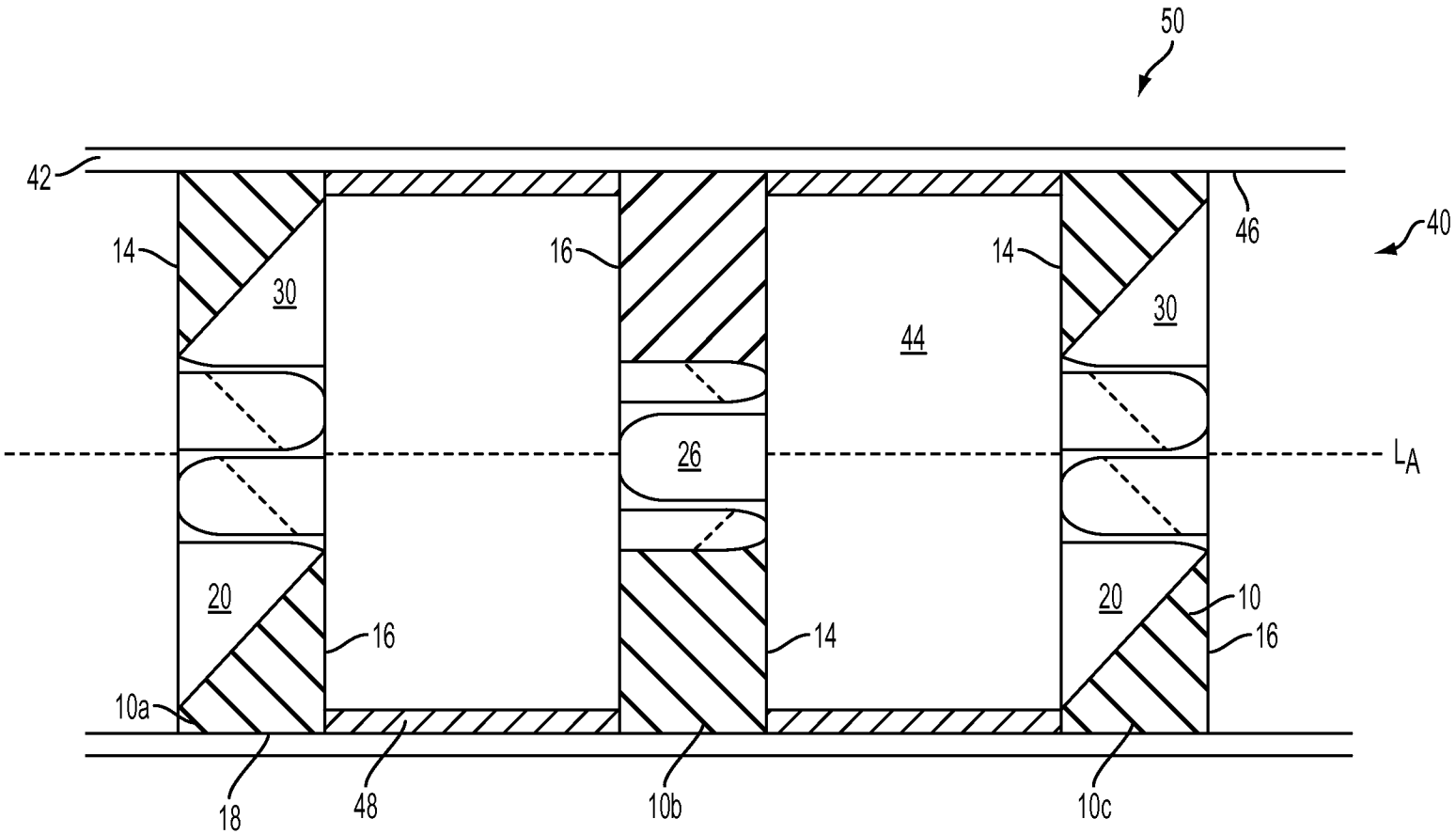
FIG. 6 is a longitudinal cross-sectional side view of a baffle stack comprising a plurality of baffles of the embodiment of FIGS. 1-5.

The firearm sound suppressor 50 comprises a generally tubular housing 42 defining an interior chamber 44 with an interior surface 46. A plurality of baffles 10 can be positioned in the interior chamber 44 of the housing to form a baffle stack 40. FIG. 6 illustrates one embodiment of a baffle stack 40 for use in a firearm sound suppressor. The baffle stack is illustrated with three baffles 10*a*, 10*b*, 10*c* of the first embodiment illustrated in series along the longitudinal axis $L_A$ of the baffle. It is of course contemplated that the baffle stack 40 can comprise more or fewer baffles. It is further contemplated that the number of baffles can be adjusted as desired based upon the caliber of firearm being discharged. For example, in one aspect, a firearm having a relatively small caliber could require a baffle stack 40 comprising three baffles 10, whereas a firearm having a larger caliber could require a baffle stack comprising six baffles. As seen in FIG. 6, the baffles of the baffle stack 40 can be rotated to any angle relative to the other baffles of the baffle stack. In one aspect, the first baffle 10*a* can be positioned as illustrated in FIG. 6, and the second baffle 10*b* can be rotated to any orientation (0° to 360°) relative to the first baffle. Each subsequent baffle can be rotated to any orientation as well.

Each of the baffles 10*a*, 10*b*, 10*c* of the baffle stack can be inserted into the chamber of the housing such that at least a portion of the peripheral wall 18 is in contact with the interior surface 46 of the housing. As noted above, either of the first face 14 or the second face 16 can be inserted first into the chamber without altering the sound-level-reducing properties of the baffle. That is, the firing direction of a projectile discharged from a firearm can be from the first face to the second face, or from the second face 16 to the first face 14 without altering the sound-level-reducing properties of the baffle 10.

In one aspect, the baffles 10 of the baffle stack 40 can be positioned in the interior chamber of the housing in a stacked orientation. For example, at least a portion of the plurality of baffles of the stacked orientation can be positioned randomly relative to the other baffles of the stacked orientation, such that each baffle 10 can be rotated to any position relative to the other baffles, and that a first face 14 of a baffle can be opposed to the second face 16 or first face of an adjacent baffle. In another example, at least a portion of the plurality of baffles of the stacked orientation can be positioned in a predetermined order relative to the other baffles. In this example, the predetermined order can comprise the first face of a baffle being opposed to the second face for each adjacent baffle in the stacked orientation. It is of course contemplated that the predetermined order can comprise any arrangement of baffles without regard to position of the first face, second face, or angle of orientation.

Between each of the baffles 10 of the baffle stack 40, an annular spacer 48 can be provided to space the baffles a predetermined distance from each other. In one aspect, the annular spacer 48 can be an annular ring having an outer spacer diameter substantially the same as the outer diameter of the baffle 10 and an inner diameter less than the outer spacer diameter. In another aspect, the annular spacer can have a spacer width configured to space the baffles of the baffle stack 40 a desired distance from each other. In a further aspect, a plurality of annular spacers 48 can be provided. In this aspect, each spacer can have substantially the same width, although it is contemplated that at least one spacer can have a different width than the other spacers.

In one aspect, the baffle stack 40 comprises a predetermined number of baffles 10 separated by at least one annular spacer 48 inserted into the suppressor housing 42. Upon assembly of a baffle stack in a firearm suppressor, pressurized burning gases produced upon discharge of the firearm are slowed to suppress the sound level of the discharge.

To clean the suppressor, the baffle stack can be easily disassembled. In one aspect, the suppressor can be disassembled without the use of tools or specialized tools. For example, an end of the housing 42 can be removed, and the baffles 10 and annular spacers 48 of the baffle stack can slide out of the interior chamber 44 of the housing. The baffles, the annular spacers, and the interior surface 46 of the housing can be cleaned by conventional means.

To assemble a baffle stack 40 in a suppressor, or to reassemble a cleaned baffle stack, each baffle 10 can be inserted into the interior chamber (without regard to which of the first face 14 and the second face 16 of the baffle is inserted first) followed by an annular spacer 48. After the desired number of baffles has been inserted into the chamber, the end of the housing 42 can be attached to the housing. In one aspect, additional annular spacers can be inserted into the interior chamber 44 of the housing to prevent the baffle stack from sliding within the chamber. For example, if fewer baffles 10 are provided from use with a small caliber firearm, additional annular spacers can be provided as necessary to prevent the baffles 10 and annular spacers 48 from moving within the housing. In one aspect, the end of the housing can exert a compressive force onto at least a portion of the baffle stack 40 and the annular spacer to prevent the prevent the baffles 10 and annular spacers 48 from moving within the housing and/or to form a gas-tight seal between each baffle and adjacent annular spacer.

Note that, due to the design of the grooves 20 and channels 30 of the baffle 10, when assembling a baffle stack 40 in a suppressor, in one aspect, it is not critical that the first baffle 10*a* be aligned with respect to the second baffle 10*b*. That is, the orientation of each baffle does not depend on the orientation of any other baffle of the baffle stack, according to this aspect. However, in an optional aspect, it is contemplated that each baffle 10 of the baffle stack 40 can be aligned relative to an adjacent baffle. In this aspect, to ease assembly, each baffle can comprise an alignment notch defined in the peripheral wall 18 configured to engage an alignment tab extending from the interior surface 46 of the housing 42.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A baffle for a firearm sound suppressor, the baffle comprising:

a first face and an opposed second face, wherein a central bore is defined in the baffle and extends from the first face to the second face, and wherein the central bore is configured to permit a projectile discharged from the firearm to freely pass through the central bore along a longitudinal axis of the baffle in a firing direction;

a peripheral wall extending between the first and second faces;

a plurality of grooves defined in the first face, wherein a proximal end of each groove of the plurality of grooves begins at a location spaced from the peripheral wall a predetermined groove distance, and wherein each groove comprises a groove axis and extends in a downwardly projecting plane intersecting:

the longitudinal axis along the groove axis downwardly from the first face towards the second face; and the central bore adjacent to a distal end of a bottom portion of each groove; and a plurality of channels defined in the second face, wherein each channel of the plurality of channels begins at a location spaced from the peripheral wall a predetermined channel distance, and wherein each channel comprises a channel axis and extends in a upwardly projecting plane intersecting:

the longitudinal axis along the channel axis upwardly from the second thee towards the first faces; and the central bore adjacent to a distal end of a bottom portion of each channel, wherein the distal ends of the respective grooves and channels define at least a portion of the central bore of the baffle.

2. The baffle of claim 1, wherein the bottom portion of each groove of the plurality of grooves comprises a substantially planar surface and wherein the bottom portion of each channel of the plurality of channels comprises a substantially planar surface.

3. The baffle of claim 2, wherein the bottom portion of each groove tapers inwardly substantially parallel to the groove axis and at an acute groove angle relative to the longitudinal axis of the baffle, and wherein the bottom portion of each channel tapers inwardly substantially parallel to the channel axis and at an acute channel angle relative to the longitudinal axis of the baffle.

4. The baffle of claim 3, wherein the groove angle is substantially the same as the channel angle.

5. The baffle of claim 1, wherein the baffle is substantially cylindrical in shape.

6. The baffle of claim 1, wherein each groove of the plurality of grooves are spaced substantially equally from each other, and wherein each channel of the plurality of channels are spaced substantially equally from each other.

7. The baffle of claim 6, wherein the plurality of grooves comprises three grooves, and wherein the groove axis of each of the three grooves is spaced about 120° from each other.

8. The baffle of claim 6, wherein an angle formed between the groove axes of adjacent grooves of the plurality of grooves is substantially equal to an angle formed between the channel axes of adjacent channels of the plurality of channels.

9. The baffle of claim 1, wherein the distal end of each groove is in fluid communication with the central bore and has a groove height extending from the first face to the second face, and wherein the distal end of each channel is in fluid communication with the central bore and has a channel height extending from the second face to the first face.

10. The baffle of claim 9, wherein the distal end of each groove is adjacent the distal end of each channel.

11. The baffle of claim 1, wherein each groove of the plurality of grooves substantially opposes a channel of the plurality of channels.

12. The baffle of claim 1, wherein the groove axis of each groove of the plurality of grooves is substantially parallel to the channel axis of a channel.

13. The baffle of claim 1, wherein the respective bottom portions of a respective pair of a substantially aligned groove and channel are positioned substantially parallel to each other and substantially parallel to the respective groove axis and channel axis.

14. The baffle of claim 1, wherein the second face is substantially the same as the first face.

15. A sound suppressor for a firearm, the sound suppressor comprising:

a generally tubular housing defining an interior chamber with an interior surface;

a plurality of baffles positioned in the interior chamber of the housing, wherein each baffle comprises:

a first face and an opposed second face, wherein a central bore is defined in the baffle and extends from the first face to the second face, and wherein the central bore is configured to permit a projectile discharged from the firearm to freely pass through the central bore along a longitudinal axis of the baffle in a firing direction;

a peripheral wall extending, between the first and second faces, wherein at least a portion of the peripheral wall is in contact with the interior surface of the housing;

a plurality of grooves defined in the first face, wherein a proximal end of each groove of the plurality of grooves begins at a location spaced from the peripheral wall a predetermined groove distance, and wherein each groove comprises a groove axis and extends in a downwardly projecting plane intersecting:

the longitudinal axis along the groove axis downwardly from the first face towards the second face; and the central bore adjacent to a distal end of a bottom portion of each groove; and a plurality of channels defined in the second face, wherein each channel of the plurality of channels begins at a location spaced from the peripheral wall a predetermined channel distance, and wherein each channel comprises a channel axis and extends in a upwardly projecting plane intersecting:

the longitudinal axis along the channel axis upwardly from the second face towards the first face; and the central bore adjacent to a distal end of a bottom portion of each channel, and wherein the distal ends of the respective grooves and channels define at least a portion of the central bore of the baffle; and at least one an annular spacer positioned between adjacent baffles of the plurality of baffles in order to space the baffles a predetermined distance from each other, wherein the at least one annular spacer is an annular ring having an outer spacer diameter substantially the same as an outer diameter of the baffle and an inner diameter less than the outer spacer diameter.

16. The sound suppressor of claim 15, wherein the plurality of baffles are positioned in the interior chamber of the housing in a stacked orientation.

17. The sound suppressor of claim 16, wherein at least a portion of the plurality of baffles of the stacked orientation are positioned randomly relative to the other baffles of the stacked orientation.

18. The sound suppressor of claim 17, wherein at least a portion of the plurality of baffles of the stacked orientation are positioned in a predetermined order.

19. The sound suppressor of claim 18, wherein the predetermined order comprises the first face of a baffle opposed to the second face for each adjacent baffle in the stacked orientation.

* * * * *

UNITED STATES PATENT AND TRADEMARK OFFICE

CERTIFICATE OF CORRECTION

PATENT NO. : 8,833,512 B2
APPLICATION NO. : 13/740991
DATED : September 16, 2014
INVENTOR(S) : Smith et al.

It is certified that error appears in the above-identified patent and that said Letters Patent is hereby corrected as shown below:

In the Claims

Column 10, claim 1, line 48, please delete “thee” and insert --face--.

Column 10, claim 1, line 48, please delete “faces” and insert --face--.

Signed and Sealed this
Twenty-fifth Day of November, 2014

Michelle K. Lee

Michelle K. Lee
*Deputy Director of the United States Patent and Trademark Office*